US008167409B2

(12) United States Patent
Suzuki et al.

(10) Patent No.: US 8,167,409 B2
(45) Date of Patent: May 1, 2012

(54) LIQUID EJECTING HEAD UNIT AND LIQUID EJECTING APPARATUS

(75) Inventors: Shigeki Suzuki, Shiojiri (JP); Satoshi Oguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 12/726,163

(22) Filed: Mar. 17, 2010

(65) Prior Publication Data

US 2010/0245480 A1 Sep. 30, 2010

(30) Foreign Application Priority Data

Mar. 25, 2009 (JP) ..... 2009-075132

(51) Int. Cl.
*B41J 2/14* (2006.01)

(52) U.S. Cl. ..... 347/50

(58) Field of Classification Search ..... 347/50, 347/57–59

See application file for complete search history.

(56) References Cited

FOREIGN PATENT DOCUMENTS

JP 2000-025207 1/2000

*Primary Examiner* — Lamson Nguyen
(74) *Attorney, Agent, or Firm* — Workman Nydegger

(57) ABSTRACT

A liquid ejecting head unit including liquid ejecting head bodies for ejecting liquid by the drive of a pressure generating device; wiring members for feeding drive signals to the pressure generating device of the liquid ejecting head bodies; and connector members provided at an end of the wiring members, being connected by the wiring members, and having second connector sections detachable from first connectors of the liquid ejecting head bodies; wherein the connector members respectively include a base member equipped with a wiring member connector for inserting the connecting end of the wiring member for connection, and a retaining member fixed to the base member covering the wiring member connector section; wherein the wiring members inserted into the wiring member connector are retained in a folded state by the retaining members.

14 Claims, 11 Drawing Sheets

LIQUID EJECTING HEAD UNIT AND LIQUID EJECTING APPARATUS

BACKGROUND

1. Technical Field

The present invention relates to a liquid ejecting head unit and a liquid ejecting apparatus.

2. Related Art

An existing liquid ejecting apparatus typified by an ink jet recording apparatus such as an ink jet printer includes a liquid ejecting head unit having a plurality of liquid ejecting heads capable of ejecting liquid such as ink stored in a cartridge, tank or the like in the form of droplets. A unit in which a plurality of liquid ejecting heads are fixed on a common retaining member or a base plate in alignment in one direction and in a state of being slightly staggered in the other direction is known as such a liquid ejecting head unit (refer to JP-A-2000-25207 as an example).

While it is plausible that a user can replace a single head that has been damaged in the above-mentioned liquid ejecting head unit, wiring members for supplying drive signals or the like to respective heads are connected to the respective heads, and problems lie in troublesome disassembly and reassembly of such wiring members or in inferior contact after reconnection.

SUMMARY

An advantage of some aspects of the invention is that it solves the above-mentioned technical problems of the related art and provides a liquid ejecting head unit with high general versatility in which a head can be relatively easily replaced by the user and which does not cause inferior contact during the replacement procedure, and a liquid ejecting apparatus employing the liquid ejecting head unit.

An aspect according to the invention provides a liquid ejecting head unit including liquid ejecting head bodies for ejecting liquid by driving a pressure generating device, wiring members for feeding drive signals to the pressure generating device of the liquid ejecting head bodies, and a connector member provided at an end of the wiring members, being connected by the wiring members, and having second connector sections detachable from first connectors of the liquid ejecting head bodies. Each of the connector member includes a base member equipped at the connecting section with the wiring member having a wiring member connector for inserting the connecting end of the wiring member for connection, and a retaining member fixed to the base member covering the wiring member connector section. The wiring member inserted into the wiring member connector is retained in a folded state by the retaining member.

According to an aspect of the invention, attachment and detachment of the wiring member from the liquid ejecting head body become easier by using the connector member, and the user may relatively readily replace the head. Since the wiring member inserted into the wiring member connector of the connector member is retained between the retaining member and the base member in the folded state, no inferior contact is caused as a result of the replacement procedure.

It is preferable that the wiring member be pinched between the base member and the retaining member with the connecting end section of the wiring member folded back on itself. In this structure, disconnection of the wiring member from the wiring member connector may be prevented more reliably, since the wiring member is pinched between the base member and the retaining member with the connecting end section of the wiring member folded back on itself.

It is also preferable that said retaining member be detachably fixed to the base member. In this structure, the wiring member may be disconnected when required by detaching the retaining member.

It is also preferable that a first sealing member for sealing the connecting section with the wiring member be provided on at least one of the abutment surfaces between the base member and the retaining member. In this structure, the connecting section of the wiring member is sealed in the space between the base member and the protecting member, thus preventing mist-like liquid from entering the space.

It is also preferable that the retaining member be made from a transparent member. In this structure, the connecting section of the wiring member may readily be checked visually, thus preventing inferior connection or the like in advance.

It is also preferable that a second sealing member for sealing the connecting section between the first connector section and the second connector section be provided on at least one of the abutment surfaces around the first connector section of the liquid ejecting head body or around the second connector section of the base member. In this structure, the connecting section between the first connector section and the second connector section is sealed by the second sealing member, thus preventing mist-like liquid from entering.

It is also preferable that a plurality of first connector sections be provided on the liquid ejecting head body, a plurality of wiring members be connected to the base member, and a plurality of the second connector sections be provided on the base member. In this structure, connection of a plurality of wiring members may be accomplished by using a single connector member.

Another aspect of the present invention is a liquid ejecting apparatus equipped with the above-mentioned liquid ejecting head unit.

According to this aspect, attachment and detachment of the wiring members from the liquid ejecting head body become easier by using the connector member, and the liquid ejecting apparatus for which the user may relatively readily replace the head may be attained. Since the wiring members inserted into the wiring member connector of the connector member are retained between the retaining member and the base member in the folded state, no inferior contact is caused during the replacement procedure.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
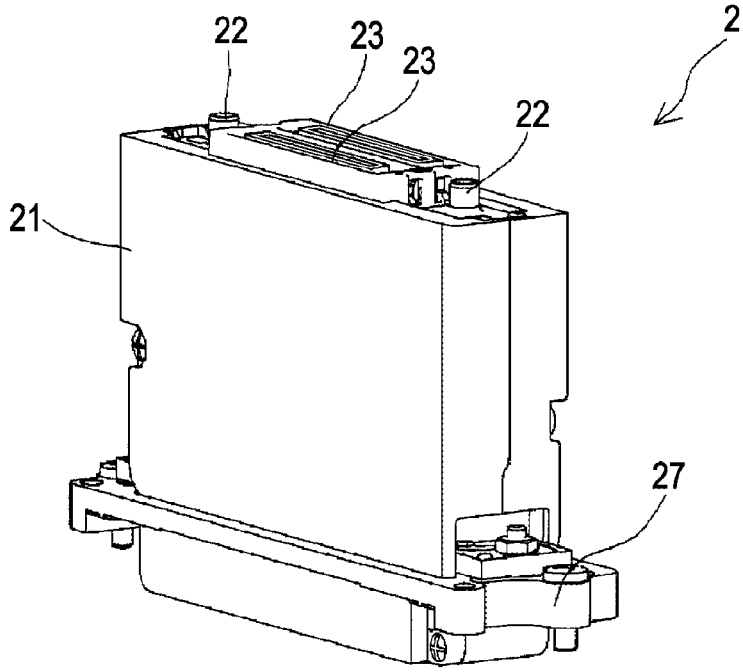
FIGS. 1A and 1B are a perspective view of the head according to an embodiment of the invention and a bottom view of the major sections.
Figure 1B:
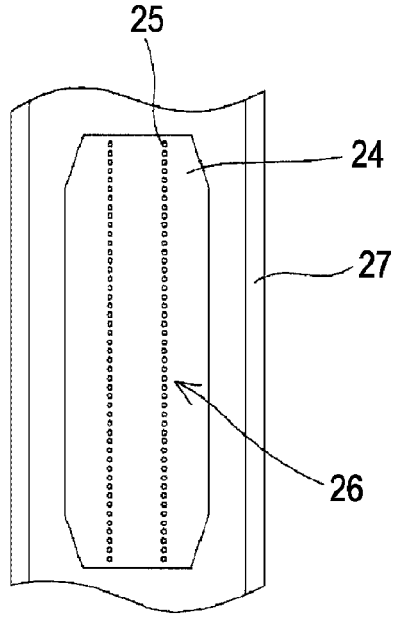

First, the ink jet recording head 2 (hereinafter simply referred to as the 'head') used for the ink jet recording head unit 1, which is a liquid ejecting head unit according to the invention (hereinafter simply referred to as the 'head unit'), is described below with reference to FIG. 1. FIG. 1 is used to explain the structure of the head. FIG. 1A is a perspective view of the head, and FIG. 1B is a bottom view of the major sections of the head.

Each of the heads 2 is equipped with a head body 21 for ejecting ink from a nozzle opening in response to an incoming drive signal. An end surface (upper end surface) of the head body 21 is provided with ink intake ports 22 for introducing ink into the head body 21, and two first connectors 23 to which connector members to be mentioned below are connected for entering drive signals. While two ink intake ports 22 are provided in the current embodiment, only one ink intake port 22 may be sufficient. Nozzle openings 25 for ejecting ink are formed on the other end surface (lower end and liquid ejecting surface) 24 of the head body 21. The nozzle openings 25 are disposed in line in the longitudinal direction of the head body 21, forming a nozzle array 26. The ink intake ports 22 and the nozzle openings 25 are connected via an ink flow path that is formed in the head body 21 and not shown in the figure. The ink flow path is provided with a pressure generator, not shown, and the respective heads 2 eject ink from the nozzle openings 25 with the aid of the pressure generator in response to drive signals input to the heads 2 via the first connector 23. A fixing member 27 for fixing the head body 21 to a base plate mentioned below is provided on the periphery of the head body 21.

Figure 6:
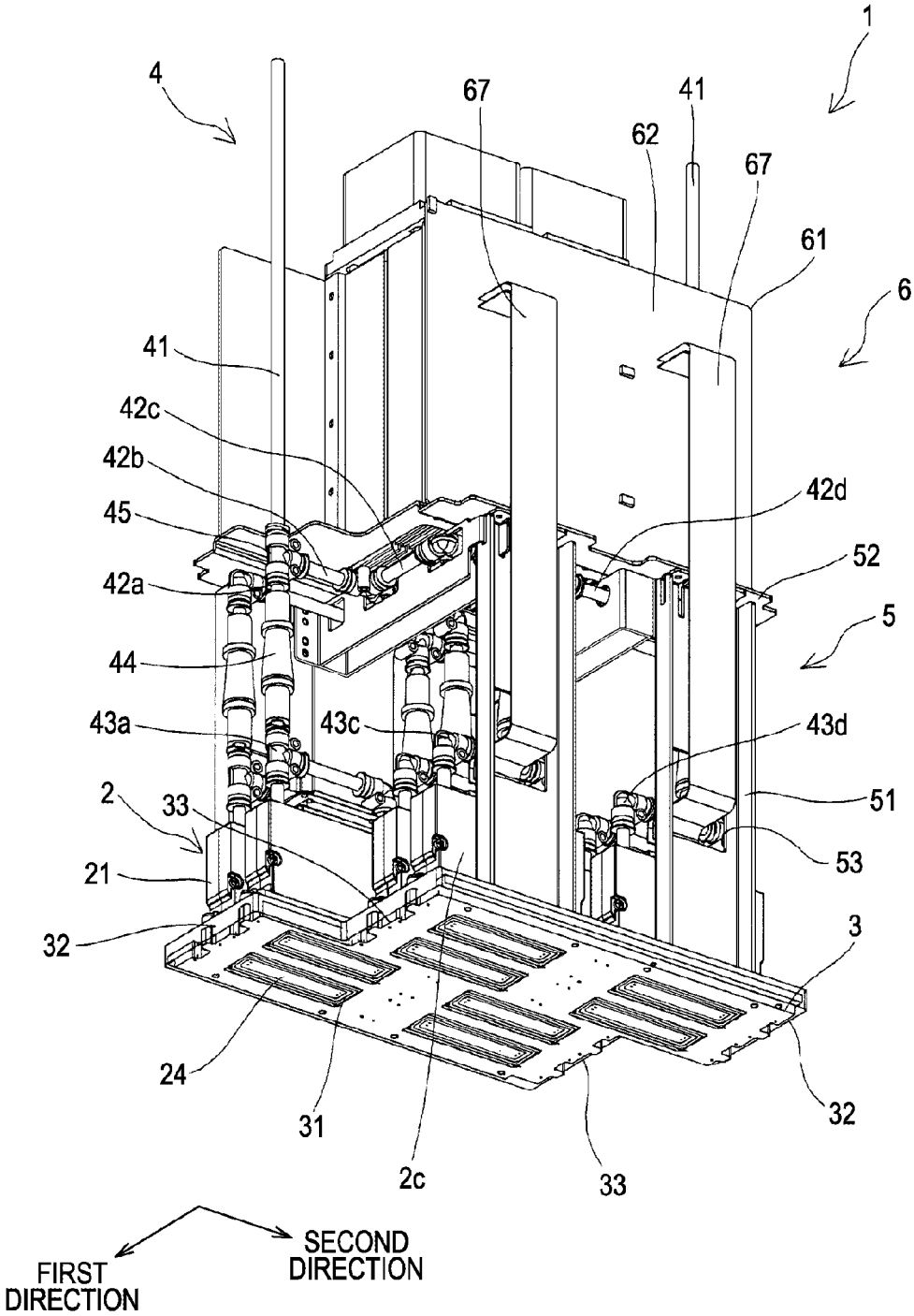
FIG. 6 is a perspective view of the head unit according to an embodiment of the present invention.

The head unit 1 according to this embodiment having a plurality of the heads 2 is now described below with reference to FIG. 6. FIG. 6 is a perspective view of the head unit. The head unit 1 is provided with a plurality of heads 2 (or eight heads in the figure as an example). Each of the heads 2 is fixed to a base plate 3 via the fixing member 27. In the description below, the direction along the short-side direction of the head body 21 in the fixed state is designated as a first direction, while the direction along the longitudinal direction of the head body 21 is designated as a second direction.

In this embodiment, all the members constituting the head unit 1, including the heads 2 (2*a* through 2*d*) fixed to the base plate 3, ink feed tubes 4 (liquid feed tube) for feeding ink to the heads 2, a frame 5 placed upright on the base plate 3, and a signal feed unit 6 mounted on the base plate 3 are structured and disposed so that they are all accommodated within a columnar space with the base plate 3 serving as the bottom surface. The details are described below. Due to the fact that the members constituting the head unit 1 are housed within the columnar space with the base plate 3 as the bottom surface as mentioned above, the head unit 1 according to this embodiment may be combined with another head unit 1 without allowing the constituting members to come into contact with each other, thus enhancing the general versatility of the unit.

Each of the heads 2 is paired with another of the heads 2 disposed in juxtaposition of the first direction, and the pair is disposed on the base plate 3 so that each pair forms a substantially staggered array pattern and that the end of a nozzle array 26 of respective heads 2 (see FIG. 1) overlaps with the end of another nozzle array 26 of another pair of the heads 2 also placed in the first direction. The nozzle arrays 26 are not interrupted in the second direction by pairs of the heads 2 being disposed in substantially staggered array pattern and the ends of the nozzle arrays being overlapped, and the heads 2 can make print for extensive areas at high speed. In addition, by disposing two heads 2 in the short-side direction of the head body 21 as a pair, the pitch of the nozzle array of a pair of the heads 2 is staggered by half a pitch, and the resolution may thus be enhanced.

The base plate 3 is formed to fit the head bodies 21, and is configured to have a staggered shape in the second direction to fit the heads 2 disposed in the substantially staggered array pattern. The base plate 3 also has a plurality of openings 31 provided so as to expose the lower end surface 24 on which the nozzle openings 25 of the heads 2 are formed.

The length of the respective head bodies 21 in the longitudinal direction is set to be twice or less the length of the nozzle opening array formed by the in-line nozzle openings 25 of the respective head bodies 21. Such a structure may reduce the installation area of the heads 2 on the base plate 3.

Figure 7:
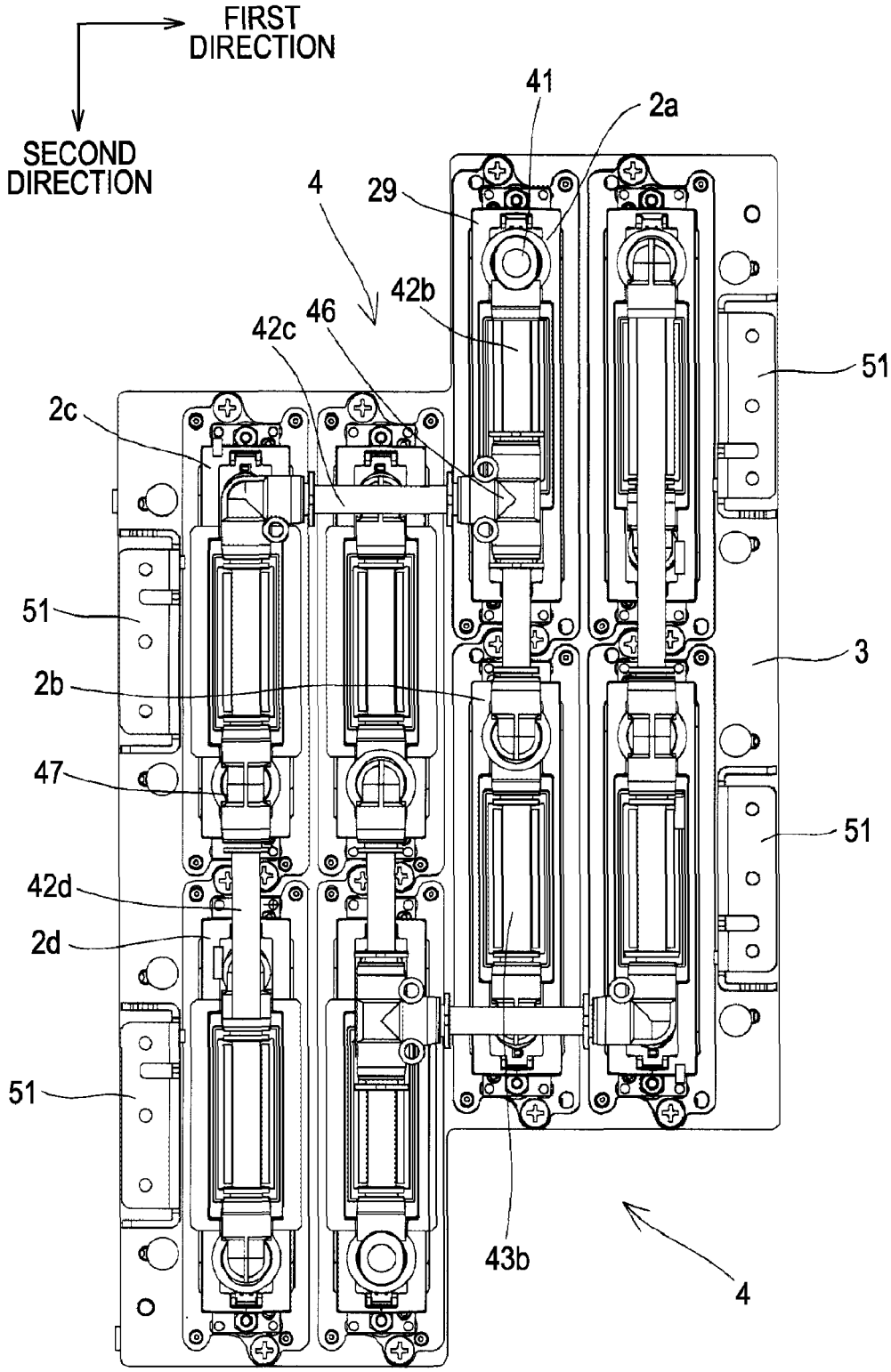
FIG. 7 is a top view of the head unit excluding the frame and the signal feed unit.

Ink feed tubes 4 connected to an ink reservoir, not shown, are connected to the ink intake ports 22 of the respective heads 2 (see FIG. 1) for feeding ink to the respective heads 2. The ink feed tubes 4 are further described below with reference to FIG. 7. FIG. 7 is a top view of the head unit excluding the frame and the signal feed unit. Two ink feed tubes 4 are provided in this embodiment.

Each of the ink feed tubes 4 includes a main channel 41, individual channels 42*a* through 42*d*, and head-side individual channels 43*a* through 43*d*. The main channel 41 is connected to an ink reservoir, not shown, at its end. The individual channels 42*a* through 42*d* branched from the main channel 41 are connected to the head-side individual channels 43*a* through 43*d* via joints 44 at their respective ends. The head-side individual channels 43*a* through 43*d* are branched into two to be connected to the respective ink intake ports 22 of a single head 2. In this case, the respective ink feed tubes 4 are structured and disposed to be accommodated within the columnar space with the base plate 3 serving as the bottom surface as shown in FIG. 7.

More specifically, the main channel 41 is branched into two individual channels 42*a* and 42*b* at a first bifurcation 45. The individual channel 42*a* is a branched flow path extending downward after the bifurcation and is connected to the head-side individual channel 43*a* connected to the head 2*a*. The head-side individual channel 43*a* is connected to the two ink intake ports 22 provided on the head 2*a*. The individual channel 42*b* extends in the horizontal direction after the bifurcation and is connected to the head-side individual channel 43*b* on the head 2*b* disposed along the first direction of the head 2*a*. From the individual channel 42*b*, an individual channel 42*c* further extends from a bifurcation 46. The individual channel 42*c* extends along the first direction after the bifurcation and is connected to the head-side individual channel 43*c* on the head 2*c* disposed in juxtaposition of the first direction of the head 2*a*. From the individual channel 42*c*, an individual channel 42*d* further extends from a bifurcation 47 and is connected to the head-side individual channel 43*d* on the head 2*d* disposed in juxtaposition of the second direction of the head 2*c*. The other ink feed tube 4 is structured in a similar manner and configured to feed ink to four heads 2.

The frame 5 is provided on the base plate 3, and the signal feed unit 6 for feeding signals for driving the respective heads is mounted on the frame 5. The frame 5 includes four legs 51 and a table 52 supported by the legs 51. Since the legs 51 are disposed in the vicinity of the head 2, or along the second direction of the base plate 3, the length of the base plate 3 in the second direction can be made shorter.

Figure 8:
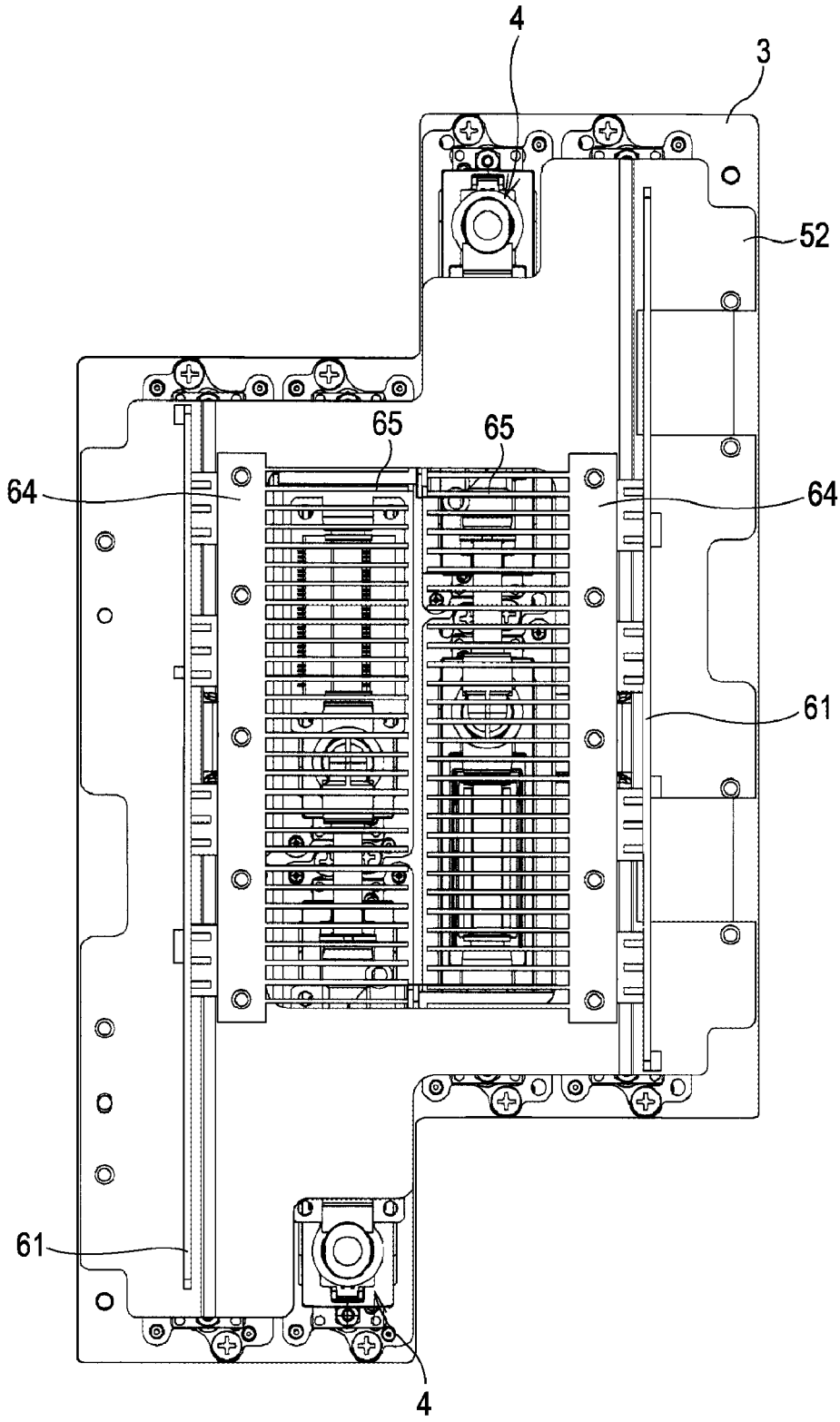
FIG. 8 is a top view of the head unit according to an embodiment of the invention.
Figure 9:
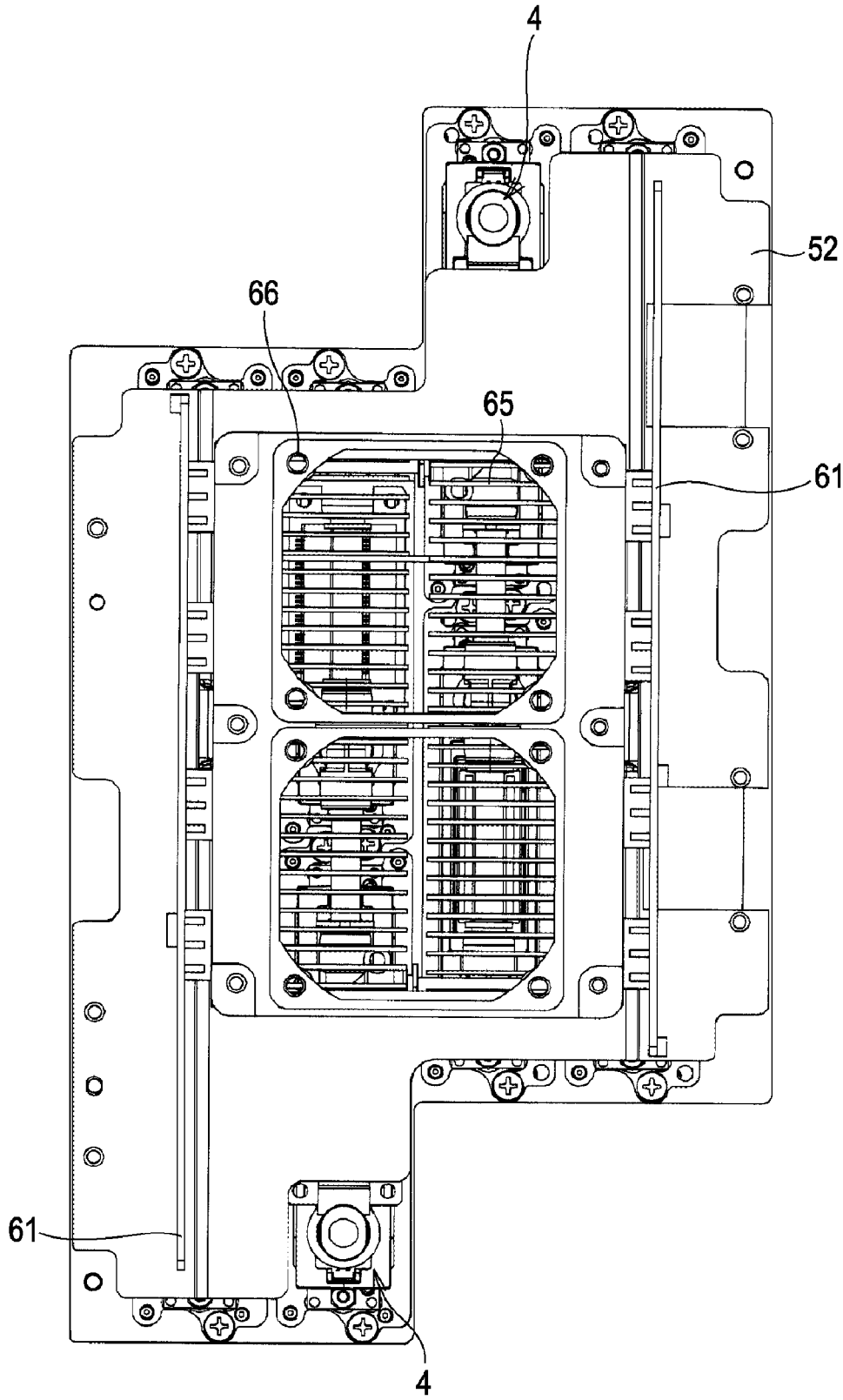
FIG. 9 is a top view of the head unit excluding the radiation member.
Figure 10:
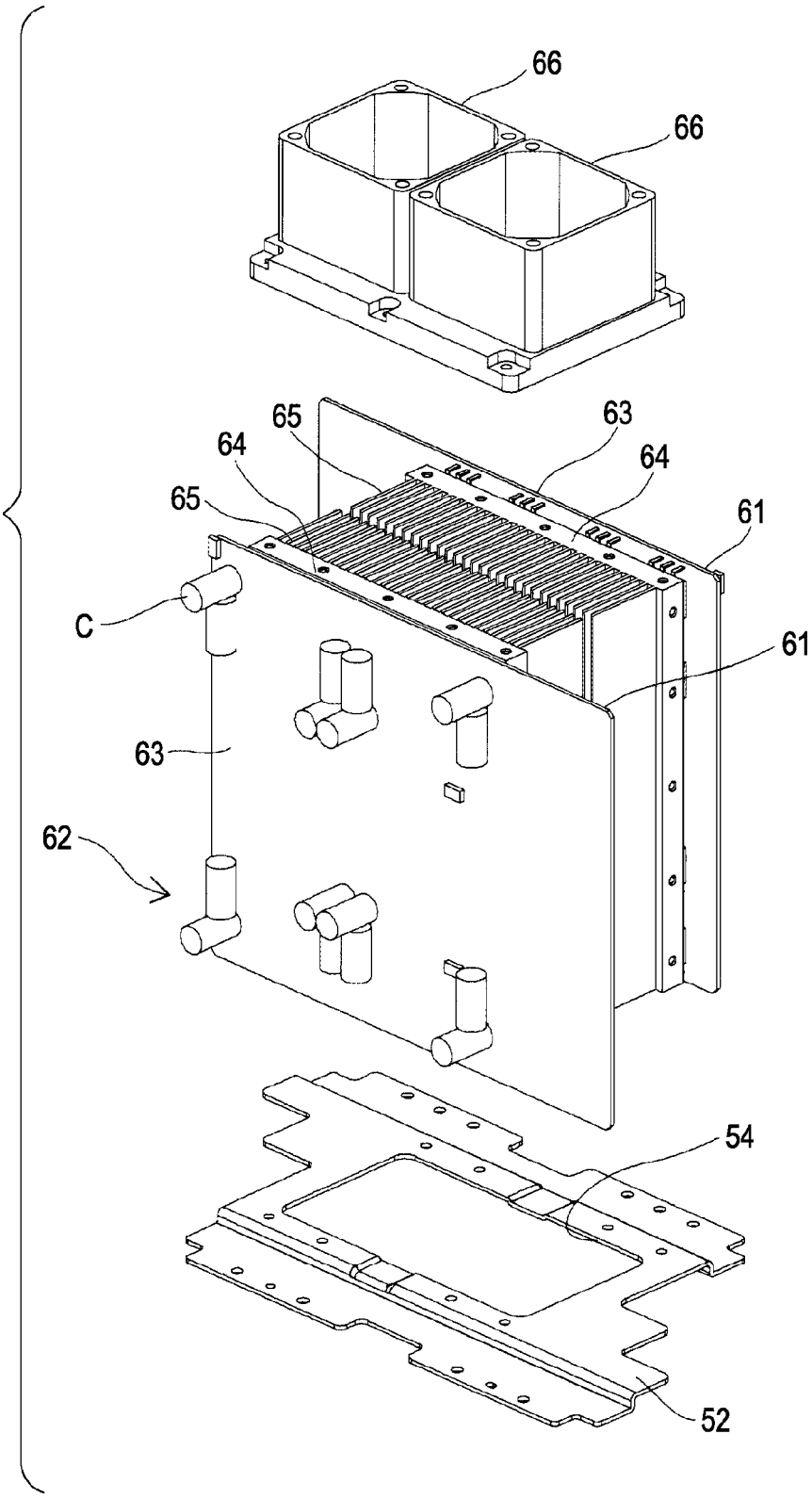
FIG. 10 is a partially exploded perspective view of the signal feed unit according to an embodiment of the invention.
Figure 11A:
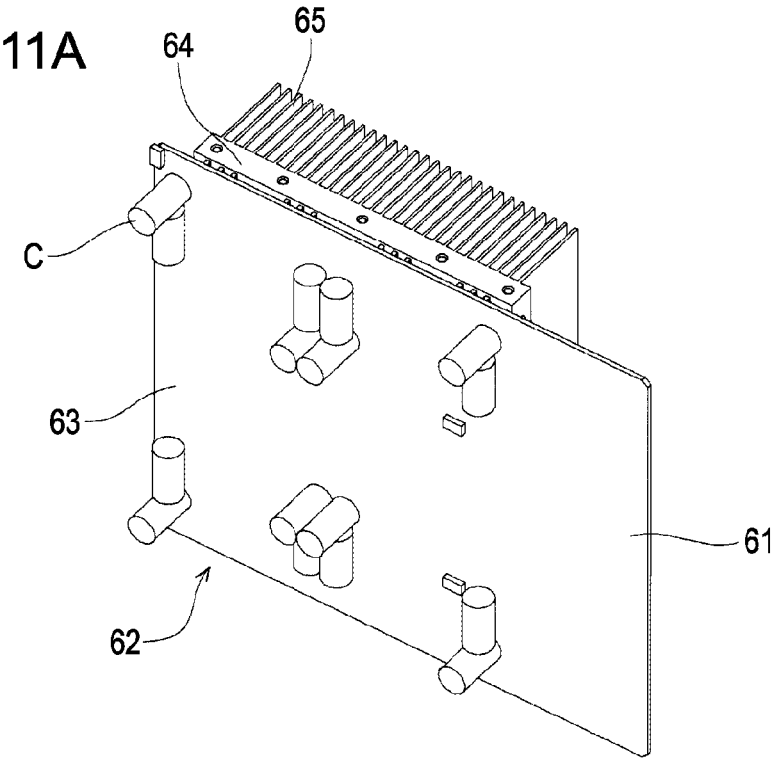
FIGS. 11A and 11B are perspective views of the major sections of the signal feed unit according to an embodiment of the invention.
Figure 11B:
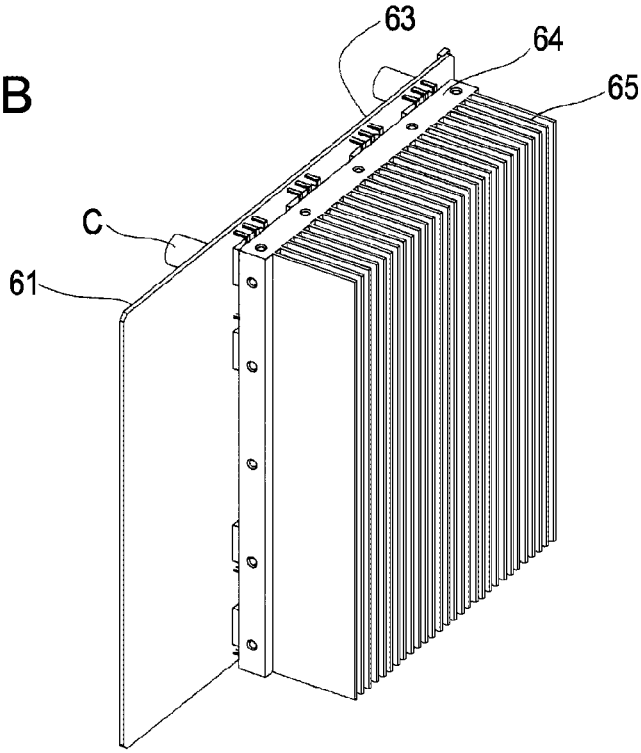

On the table 52, the signal feed unit 6 is mounted. The signal feed unit 6 is described in detail with reference to FIGS. 8 through 11. FIG. 8 is a top view of the head unit. FIG. 9 is a top view of the head unit excluding the radiation member. FIG. 10 is a partially exploded perspective view of the signal feed unit. FIG. 11 is a perspective view of the major sections of the signal feed unit.

As shown in FIG. 8, both the frame 5 and the signal feed unit 6 are entirely accommodated in the columnar space with the base plate 3 as the bottom surface. The signal feed unit 6 is provided with a pair of circuit substrates 61. Each of the circuit substrates 61 is for feeding drive signals to the head body 21 of two pairs of heads 2 disposed in juxtaposition of the second direction. The circuit substrates 61 are disposed in juxtaposition so that circuit forming surfaces 63 formed with circuit forming sections 62 on which capacitor C's or the like (omitted from figures other than FIGS. 10 and 11) of the circuit substrates 61 are mounted in juxtaposition face outward away from each other and that the circuit forming sections 62 overlap. A heat sink (radiator) 64 for radiating heat generated by the circuit substrates 61 is provided between the circuit forming sections 62. On the heat sink 64, fins 65 are provided in the direction perpendicular to the base plate 3 to enhance the radiation efficiency of the heat sink 64. As shown in FIG. 10, an opening 54 is formed on the section of the frame 5 facing the fins 65 to further facilitate discharge of the radiated heat. The upper part of the heat sink 64 is provided with tubular members 66. Since the signal feed unit 6 according to this embodiment is provided with the fins 65 in the direction perpendicular to the base plate 3 and also provided with the opening 54 and the tubular members 66 facing the fins 65, it is constructed to readily radiate heat in the direction perpendicular to the base plate 3.

An end of a wiring member (for example, flexible flat cable (FFC)) 67 for feeding drive signals to the respective heads 2 is connected to the circuit substrate 61. The FFC 67 is connected at an end to an FFC connector, not shown, of the circuit forming section 62 of the circuit substrate 61 and at the other end to a connector member 70, to be described in detail below. The FFC 67 is then connected to the first connector 23 of the head body 21 via the connector member 70, and drive signals are fed via the FFC 67 to the respective head bodies 21.

An opening 53 is provided in the leg 51 of the frame 5, and the FFC 67 is to be inserted through the opening 53. Since the legs 51 are provided in the vicinity of the head 2 as hereinbefore mentioned, connection to the head 2 via the connector member 70 may be accomplished without bending the FFC 67 by inserting the FFC 67 through the opening 53.

Figure 2A:
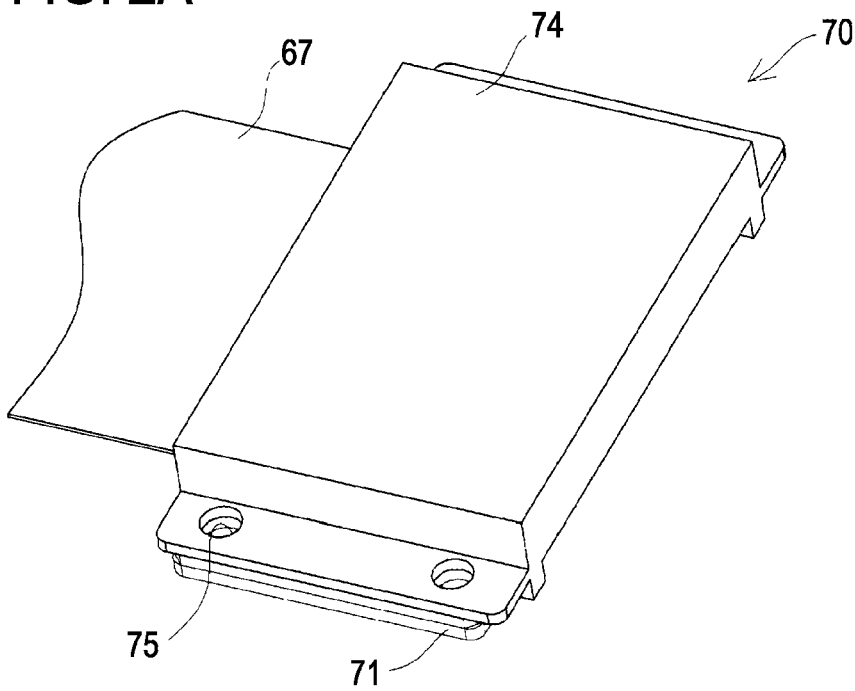
FIGS. 2A and 2B are exploded perspective views of the connector member according to an embodiment of the invention.
Figure 2B:
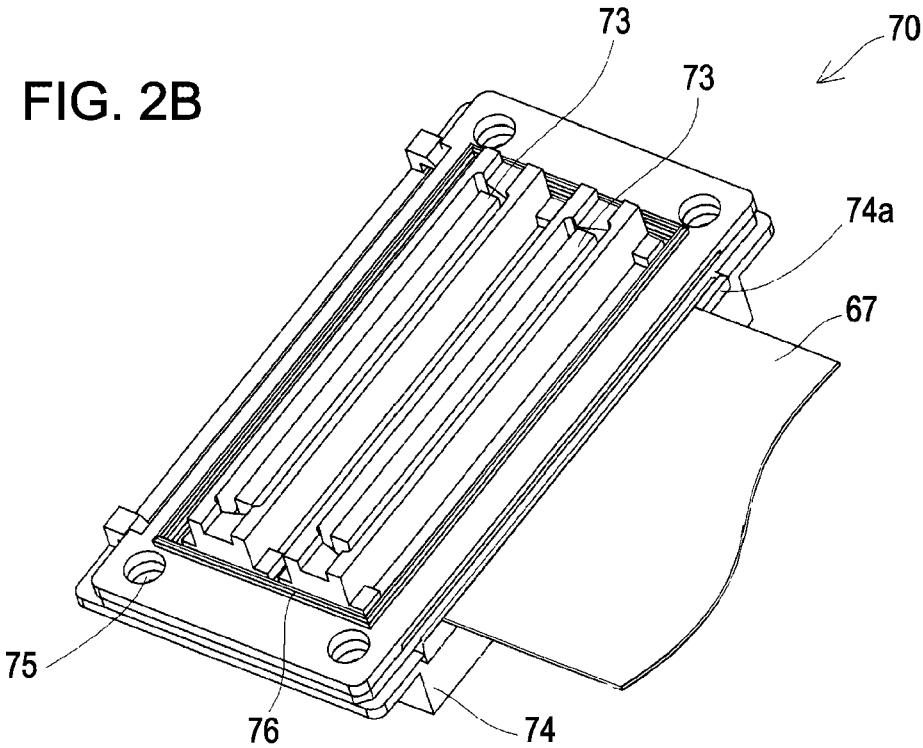
Figure 3:
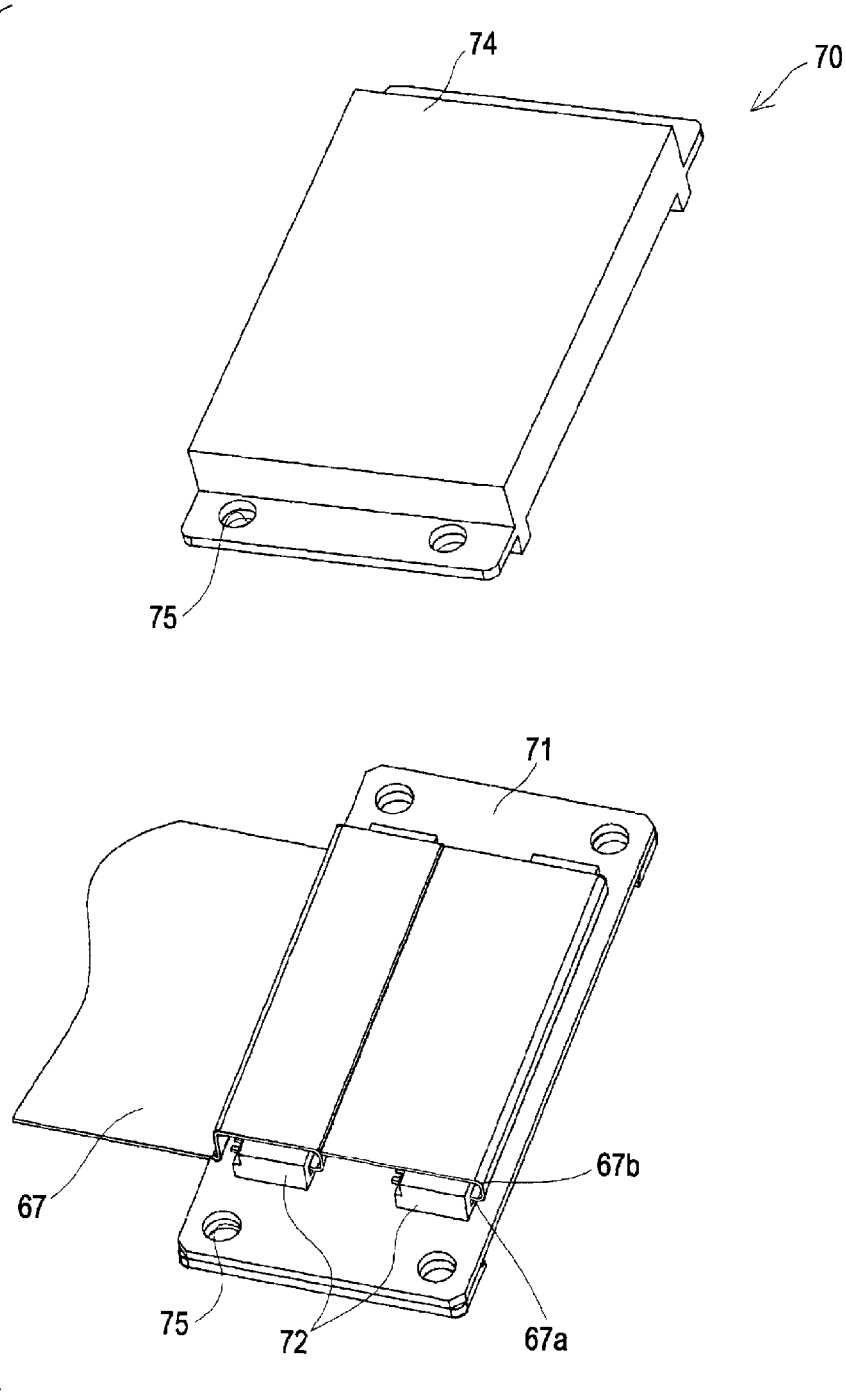
FIG. 3 is an exploded perspective view of the connector member according to an embodiment of the invention.
Figure 4:
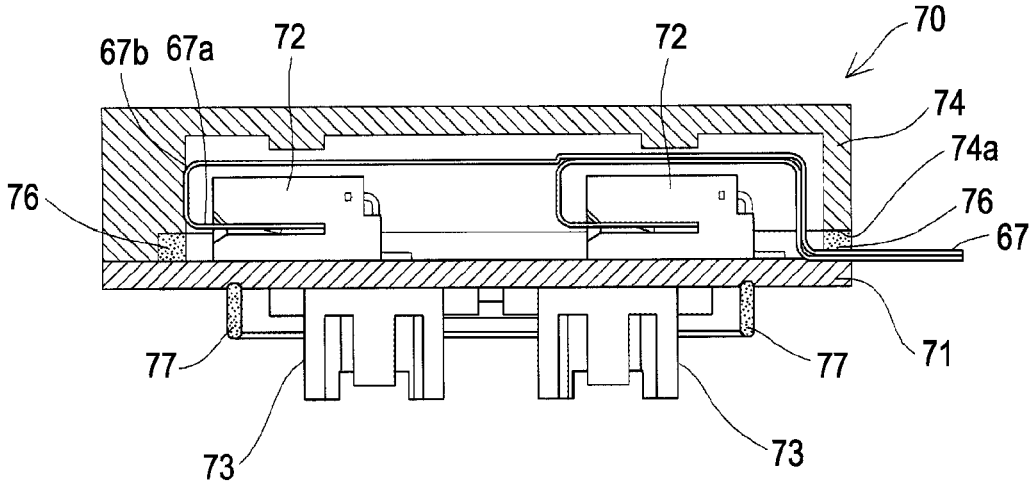
FIG. 4 is a cross-sectional view of the connector member according to an embodiment of the invention.
Figure 5:
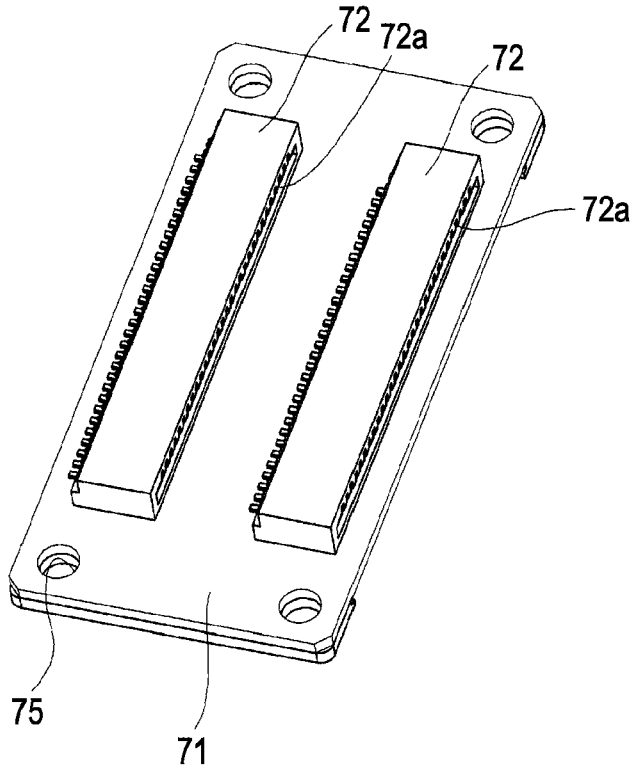
FIG. 5 is a perspective view of the base member of the connector member according to an embodiment of the invention.

The details of the connector member 70 are now described with reference to FIGS. 2 through 5. FIGS. 2 and 3 are exploded perspective views of the connector member. FIG. 4 is a cross-sectional view, and FIG. 5 is a perspective view of the base member with the FCC removed.

As shown in these figures, the connector member 70 includes a base member 71 serving as an interface substrate, two FFC connectors 72 which are wiring member connectors provided on a side (upper side in the figure) of the base member 71 for connecting the connecting end of the FFC 67, two second connectors 73 which are provided on the other side and may be connected to the first connector 23 of the above-mentioned head 2, and a protective member 74 covering the FFC connector 72. The base member 71 and the protective member 74 are mutually fastened by using fastening holes 75.

The FFC connector 72 has been provided on the head 2 in the related art, and has a connecting section 72*a* for inserting the end of the FFC 67 from a side of the base member 71 (mid to right side in FIGS. 3 and 4) in the direction parallel to the face of the base member 71 for connection. The ends 67*a* of the FFC 67 inserted into the connecting section 72*a* are folded back to the opposite side by 180° at a folding section 67*b*, disposed over the FFC connector 72, disposed to extend to the outside of the other side of the base member 71, and pressed by the protective member 74 to maintain this state. In this manner, the FFC 67 does not come off from the connecting section 72*a* of the FFC connector 72 even when the FFC is pulled. To ensure holding of the FFC 67 by the protective member 74, an elastic member or the like may be provided inside the protective member 74 to press the FFC 67.

Since the connecting section between the FFC connector 72 and the FFC 67 is covered by the protective member 74 in this embodiment, it is immune to mist-like ink floating in the external atmosphere, for example. However, to shield the connecting section against the external atmosphere more completely, a first sealing member 76 including an elastic member such as one composed of silicone rubber is provided on the periphery of one of the abutment surfaces of the base member 71 and the protective member 74 to seal the space between the base member 71 and the protective member 74 and to reliably shield the connecting section against the external atmosphere. While an opening 74*a* is provided in the protective member 74 to allow the FFC 67 to extend to the outside, another first sealing member 76 is provided on the opening 74*a* to seal the opening 74*a*.

In contrast, the second connector 73 is a connector detachably connectable to the first connector 23 and the type is not specifically limited. While the first connector 23 is male and the second connector 73 is female in the embodiment, they may naturally be opposite. The first connector 23 and the second connector 73 may be readily connected by pressing the connector member 70 against the upper surface of the head 2 and readily disconnected by pulling up the connector member 70.

In the embodiment, a second sealing member 77 including an elastic member such as one composed of silicone rubber is provided on the periphery of the rear side of the base member 71 on which the second connector 73 is provided so as to isolate the connection between the first connector 23 and the second connector 73 from the external environment. In this structure, the second sealing member 77 tightly adheres to the upper surface of the head 2 when the first connector 23 and the second connector 73 are connected, and thus the connection between the first connector 23 and the second connector 73 may be isolated from the external environment. By this structure, even mist-like ink floating in the external atmosphere, for example, does not affect the connection.

While the FFC 67 is prevented from being disconnected from the FFC connector 72 by folding and drawing the end 67*a* of the FFC 67 in the opposite direction and retaining it with the protective member 74 in the connector member 70 according to the hereinbefore-mentioned embodiment, the protective member 74 may be undetachable and may be molded with molding resin.

It is obvious that the protective member 74 is preferably undetachable to prevent even the slightest possibility of accidental detachment. The protective member 74 may be made from transparent resin to allow constant visual checking of the connection of the FFC 67 to the FFC connector 72. This structure may enable easy checking of the connecting state and prevent accidents such as defective discharge due to inferior connection in advance.

The head unit 1 of this structure has its constituting members disposed and structured to be accommodated within the columnar space with the base plate 3 as the bottom surface. In other words, in the head unit 1, all the constituting components including a plurality of heads 2, ink feeding tubes 4, frame 5 and signal feed unit 6 are disposed so as to be not observable when viewed from underneath the base plate 3.

Figure 12:
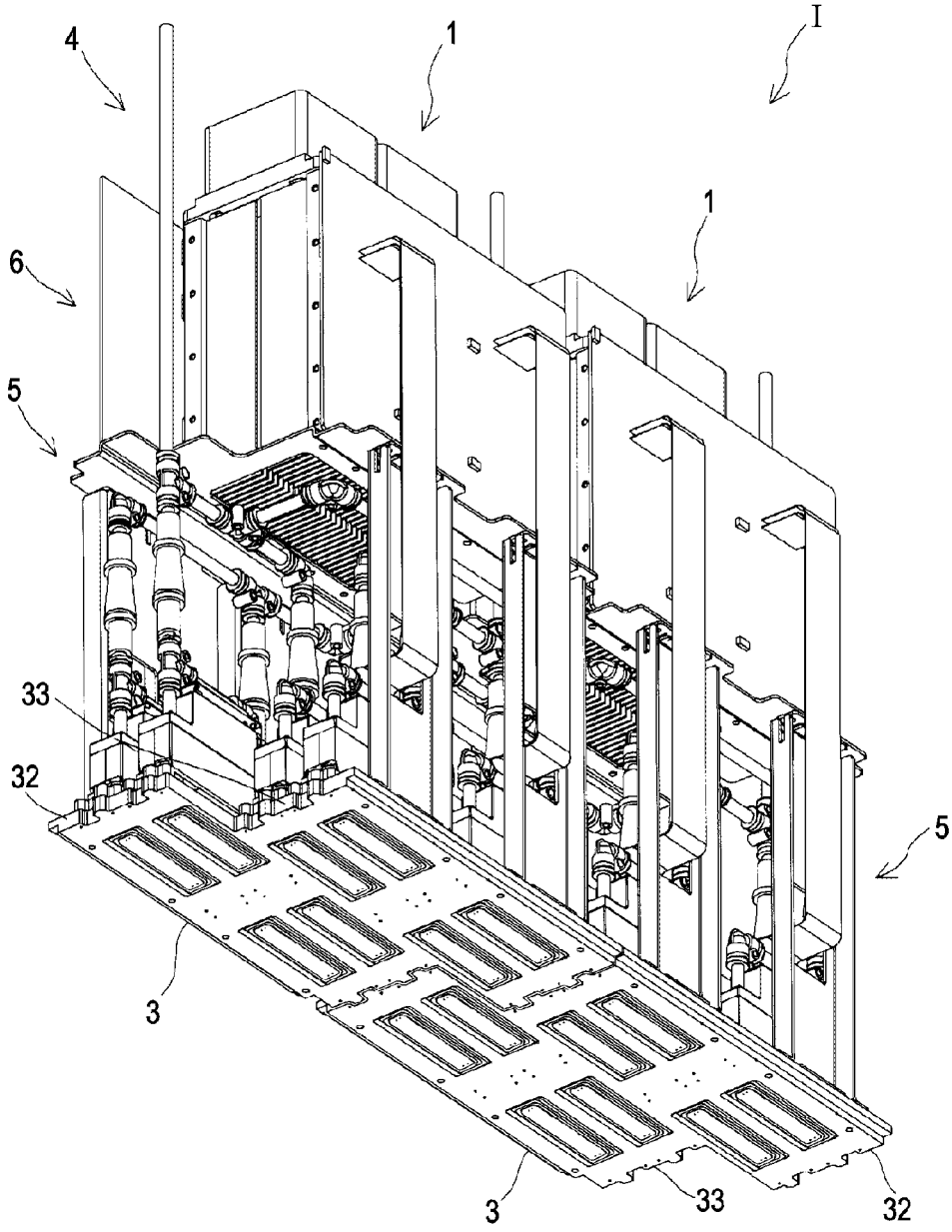
FIG. 12 is a perspective view of the head unit according to an embodiment of the invention.

Since all the constituting members are constructed to be accommodated within the columnar space with the base plate 3 as the bottom surface, two or more of the head units 1 according to the embodiment 2 may be connected without allowing the constituting members to come into contact, thus enhancing general versatility. As shown in FIG. 12, for example, a plurality of the head units 1 may be disposed in the longitudinal direction of the head body 21 to construct a single head unit I. In this case, since the heads 2 are disposed in the houndstooth check pattern and the base plate 3 is dislocated in the second direction, a convex section 32 on the base plate 3 of the single head unit I may be mated into a concave section 33 on the base plate 3 of another head unit. Even in such a case, the nozzle arrays 26 (see FIG. 1) of the heads 2 have their ends overlapping with each other, and thus the single head unit I connecting a plurality of head units 1 does not have nozzle arrays not interrupted in the second direction. Accordingly, the heads 2 can make print for extensive areas at high speed. The respective heads 2, respective ink feed tubes 4, frame 5 and signal feed unit 6 are disposed in rotational symmetry with the center of the base plate 3 as the axis of symmetry. This structure eliminates consideration for the connection direction when the head unit 1 is connected, thus enhancing the general versatility.

The head unit 1 according to the embodiment may be applied to the so-called line recording apparatus with which recording may be attained simply by feeding a medium to be recorded in the first direction since the first direction is matched to the transfer direction of the medium to be recorded such as the recording paper or substrate of the liquid ejecting apparatus typified by the ink jet recording apparatus.

The liquid ejecting apparatus is not limited to this structure. The head unit 1 may be mounted on a moving device such as a carriage provided that is movable in the direction orthogonal to the transfer direction of the medium to be recorded, and thus printing may be made on the medium to be recorded with width wider than the length of the continuous nozzle arrays in the second direction. In short, the head unit 1 may be disposed in such a manner that the first direction is the same as the transfer direction of the medium to be recorded, and printing is accomplished while moving the head unit 1 in the second direction and the medium to be recorded in the first direction.

While eight heads 2 are fixed on a single base plate 3 to form the head unit 1 in the above-mentioned embodiment, the number of heads is not limited to this, and two or more heads 2 may be used to construct the head unit 1.

What is claimed is:

1. A liquid ejecting head unit comprising:

liquid ejecting head bodies for ejecting liquid by the drive of a pressure generating device;

wiring members for feeding drive signals to the pressure generating device of the liquid ejecting head bodies; and connector members provided at an end of the wiring members, being connected by the wiring members, and having second connector sections detachable from first connectors of the liquid ejecting head bodies;

wherein the connector members respectively include a base member equipped with a wiring member connector for inserting the connecting end of the wiring member for connection, and a retaining member fixed to the base member covering the wiring member connector section;

wherein the wiring members inserted into the wiring member connector are retained in a folded state by the retaining members.

2. The liquid ejecting head unit set forth in claim 1, wherein the wiring member is pinched between the base member and the retaining member with the connecting end folded back on itself.

3. A liquid ejecting apparatus comprising the liquid ejecting head unit set forth in claim 2.

4. The liquid ejecting head unit set forth in claim 1, wherein the retaining member is detachably fixed to the base member.

5. The liquid ejecting head unit set forth in claim 4, wherein at least one of the abutment surfaces of the base member and the retaining member is provided with a first sealing member for sealing the connection with the wiring member.

6. A liquid ejecting apparatus comprising the liquid ejecting head unit set forth in claim 5.

7. The liquid ejecting head unit set forth in claim 4, wherein the retaining member is made from a transparent member.

8. A liquid ejecting apparatus comprising the liquid ejecting head unit set forth in claim 7.

9. A liquid ejecting apparatus comprising the liquid ejecting head unit set forth in claim 4.

10. The liquid ejecting head unit set forth in claim 1, wherein a second sealing member for sealing the connecting section for the first connector section and the second connector section is provided on at least one of the abutment surfaces around the first connector section of the liquid ejecting head body or the second connector section of the base member.

11. A liquid ejecting apparatus comprising the liquid ejecting head unit set forth in claim 10.

12. The liquid ejecting head unit set forth in claim 1, wherein a plurality of first connector sections are provided on the liquid ejecting head body, a plurality of wiring members are connected to the base member, and a plurality of the second connector sections are provided on the base member.

13. A liquid ejecting apparatus comprising the liquid ejecting head unit set forth in claim 12.

14. A liquid ejecting apparatus comprising the liquid ejecting head unit set forth in claim 1.

* * * * *